US007207850B2

(12) United States Patent
Takayama

(10) Patent No.: US 7,207,850 B2
(45) **Date of Patent: *Apr. 24, 2007**

(54) WIRE PRESS-CLAMPING METHOD

(75) Inventor: Tsutomu Takayama, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/420,548

(22) Filed: May 26, 2006

(65) Prior Publication Data

US 2006/0205287 A1 Sep. 14, 2006

Related U.S. Application Data

(63) Continuation of application No. 11/101,545, filed on Apr. 8, 2005.

(30) Foreign Application Priority Data

Apr. 9, 2004 (JP) ..... P2004-115538

(51) Int. Cl.
*H01R 13/11* (2006.01)

(52) U.S. Cl. ..... 439/852; 439/850; 439/851

(58) Field of Classification Search ..... 439/851, 439/852, 853, 854, 848
See application file for complete search history.

(56) References Cited

U.S. PATENT DOCUMENTS 3,777,302 A * 12/1973 Travis ..... 439/854
4,921,456 A * 5/1990 French ..... 439/851
5,533,914 A * 7/1996 Sawada ..... 439/843
5,599,212 A * 2/1997 Sawada ..... 439/843
5,611,715 A * 3/1997 Samejima ..... 439/850
5,685,747 A * 11/1997 Rodriguez ..... 439/852
5,989,078 A * 11/1999 Chaillot et al. ..... 439/851
6,264,509 B1 * 7/2001 Kwang et al. ..... 439/852
6,527,601 B2 * 3/2003 Chen ..... 439/852
2001/0002350 A1 * 5/2001 Kashiyama et al. ..... 439/848
2002/0076999 A1 * 6/2002 Chen ..... 439/851

FOREIGN PATENT DOCUMENTS

JP 11-3733 A 1/1999
JP 2000-251961 A 9/2000

* cited by examiner

*Primary Examiner*—Tulsidas C. Patel
*Assistant Examiner*—Harshad C Patel
(74) *Attorney, Agent, or Firm*—Sughrue Mion, PLLC

(57) ABSTRACT

In a wire press-clamping method of press-clamping a conductor of a wire to a conductor press-clamping portion of a press-clamping terminal in electrically-connected relation thereto, there is used the press-clamping terminal having conductor press-fastening piece portions for press-fastening the conductor, and a press-clamping member is interposed between the conductor press-clamping portion and the conductor, and is press-fastened by the conductor press-fastening piece portions.

6 Claims, 8 Drawing Sheets

WIRE PRESS-CLAMPING METHOD

This is a continuation of application Ser. No. 11/101,545 filed Apr. 8, 2005. The entire disclosure of the prior application, application Ser. No. 11/101,545 is hereby incorporated by reference.

BACKGROUND OF THE INVENTION

This invention relates to a wire press-clamping method for press-clamping a conductor of a wire to a press-clamping terminal.

There is known one related wire press-clamping method for press-clamping a conductor of a wire to a press-clamping terminal, in which an electrically-conductive member is provided (see, for example, Patent Literature 1).

As shown in FIG. 10, the press-clamping terminal 70, disclosed in Patent Literature 1, includes an electrical contact portion 71, and a wire press-clamping portion 72. The wire press-clamping portion 72 includes a conductor press-clamping portion 75 for press-clamping the conductor 74 of the wire 73, and a sheath press-clamping portion 77 for press-clamping a sheath 76 of the wire 73. The narrow electrically-conductive member 78 is provided at the conductor press-clamping portion 75, and extends over an entire width thereof. The electrically-conductive member 78 fills in a gap, formed between the conductor press-clamping portion 75 and the conductor 74 during the press-clamping operation, in a gastight manner.

There is known another related wire press-clamping method for press-clamping a conductor of a wire to a press-clamping terminal, in which serrations are formed at a wire barrel portion (see, for example, Patent Literature 2).

As shown in FIG. 11, the press-clamping terminal 80, disclosed in Patent Literature 2, includes the wire barrel portion 82 and an insulation barrel portion 84 which are formed integrally with each other, and are juxtaposed in a direction of a length of a terminal body 81. The conductor 86 and a sheath end portion 87 of the wire 85 are press-clamped respectively to the two barrel portions 82 and 84, and therefore are connected thereto. The plurality of parallel serrations 88 are formed at the wire barrel portion 82, and extend in one direction. The serrations 88 prevent the conductor 86 of the wire 85 and the wire barrel portion from being displaced relative to each other at areas of contact between the inner periphery of the wire barrel portion 82 and the conductor 86 during the time when the conductor 86 of the wire 85 is connected to the wire barrel portion 82 by press-clamping.

Patent Literature 1: JP-A-2000-251961 (Pages 2 to 3, FIG. 1)

Patent Literature 2: JP-A-11-003733 (Pages 2 to 3, FIG. 1)

When a conductor of a wire is electrically connected to a press-clamping terminal by press-fastening (press-clamping), a mechanical strength of the press-fastened conductor usually decreases to a level lower than a breaking strength of the conductor. Here, whether the conductor is made of copper or aluminum, the degree of decrease of the mechanical strength thereof is generally the same. However, the aluminum conductor is lower in breaking strength than the copper conductor, and therefore there is a fear that the aluminum conductor cannot withstand an applied force when a wire harness is assembled. Namely, there is a fear that the aluminum conductor is cut during the press-fastening (press-clamping) operation since the aluminum conductor is relatively low in strength, and therefore it is desired that the aluminum conductor will not be squeezed during the press-fastening operation. However, unless the aluminum conductor is adequately squeezed, there arises a problem that the area of contact of the conductor decreases, so that the electrical resistance increases.

Therefore, when the conductors 74 and 86 in the above Patent Literatures 1 and 2 are made of aluminum, there is countered a problem that the area of contact of the conductor decreases, so that the electrical resistance increases, which makes it difficult to flow an electric current of a predetermined value through the wire.

SUMMARY OF THE INVENTION

This invention has been made in view of the above circumstances, and an object of the invention is to provide a wire press-clamping method that can increase a contact area so as to decrease an electrical resistance.

(1) A method of press-clamping a wire that includes a conductor to a press-clamping terminal that includes a conductive press-clamping terminal body, a conductor press-clamping portion formed at the press-clamping terminal body, and conductor press-fastening piece portions that are extended from opposite sides of the conductor press-clamping portion in an axial direction, the method comprising:

disposing the conductor and a conductive press-clamping member so that the press-clamping member is interposed between the conductor press-clamping portion and the conductor so as to be held in contact with the conductor press-clamping portion and the conductor; and press-fastening the conductor press-fastening piece portions, thereby clamping the wire to the press-clamping terminal through the press-clamping member.

(2) The method of press-clamping the wire to the press-clamping terminal according to (1), wherein in the disposing step, the press-clamping member is mounted on the conductor press-clamping portion in a mounting direction perpendicular to the axial direction, and the conductor is mounted on the press-clamping member in the mounting direction.

(3) The method of press-clamping the wire to the press-clamping terminal according to (2), wherein in the disposing step, the press-clamping member is mounted on the conductor press-clamping portion, before the conductor is mounted on the press-clamping member.

(4) The method of press-clamping the wire to the press-clamping terminal according to (1), wherein the press-clamping member covers the conductor, and wherein in the disposing step, the press-clamping member and the conductor are integrally mounted on the conductor press-clamping portion.

(5) The method of press-clamping the wire to the press-clamping terminal according to (1), wherein the wire includes a sheath that covers the conductor, and the press-clamping terminal includes sheath press-fastening piece portions that are extended from opposite sides of an end portion of the press-clamping terminal body in the axial direction, wherein the press-clamping member covers the conductor and a portion of the sheath corresponding to the sheath press-fastening piece portions, wherein in the disposing step, the press-clamping member that covers the conductor and the portion of the sheath corresponding to the sheath press-fastening piece portions is mounted on the conductor press-clamping portion, and wherein in the press-fastening step, the sheath press-fastening piece portions are press-fastened to a portion of the press-clamping member corresponding to the portion of the sheath.

(6) The method of press-clamping the wire to the press-clamping terminal according to (1), wherein the press-clamping member is analogous in shape to a groove portion formed by the conductor press-clamping portion and the conductor press-fastening piece portions, and wherein in the disposing step, the press-clamping member is fitted into the groove portion.

(7) The method of press-clamping the wire to the press-clamping terminal according to (1), wherein the press-clamping member includes a retaining portion that is engaged with the conductor press-fastening piece portions, and wherein in the disposing step, the press-clamping member is retainingly engaged with the conductor press-fastening piece portions.

(8) The method of press-clamping the wire to the press-clamping terminal according to (1), wherein the press-clamping member includes serrations that are arranged at an surface that is held contact with the conductor, and extend in a direction perpendicular to an axis of the press-clamping member.

(9) The method of press-clamping the wire to the press-clamping terminal according to (1), wherein an axial length of the press-clamping member is substantially equal to an axial length of the conductor press-fastening piece portion.

(10) A terminal-connected wire comprising:

a wire that includes a conductor;

a press-clamping terminal that includes:

a conductive press-clamping terminal body;

an electrical connecting portion that is formed at an end portion of the press-clamping terminal body, and is connected to a mating terminal;

a conductor press-clamping portion that is formed at a portion corresponding to the conductor; and conductor press-fastening piece portions that are extended from opposite sides of the conductor press-clamping portion in an axial direction; and a conductive press-clamping member that is held in contact with the conductor, wherein the conductor press-fastening piece portions is press-fastened to the press-clamping member, so that the conductor is electrically connected to the conductor press-clamping portion through the press-clamping member.

(11) The terminal-connected wire according to (10), wherein the press-clamping member includes serrations that are arranged at an surface that is held contact with the conductor, and extend in a direction perpendicular to an axis of the press-clamping member.

(12) The terminal-connected wire according to (10), wherein an axial length of the press-clamping member is substantially equal to an axial length of the conductor press-fastening piece portion.

(13) The terminal-connected wire according to (10), wherein the press-clamping member includes a retaining portion that is engaged with the conductor press-fastening piece portions.

(14) The terminal-connected wire according to (10), wherein the wire includes a sheath that covers the conductor, and the press-clamping terminal includes sheath press-fastening piece portions that are extended from opposite sides of a portion opposed to the electrical connecting portion of the press-clamping terminal body in the axial direction, and wherein the sheath press-fastening piece portions are press-fastened to the sheath.

According to the invention, the press-clamping member has the function of stabilizing an electrical resistance without compressing the conductor. Therefore, during the time when the wire is press-clamped by the press-fastening of the conductor press-fastening piece portion, a mechanical strength of the conductor is decreasing to a level lower than a breaking strength of the conductor. In contrast, the press-clamping member serves to increase the pressure of contact between the press-clamping terminal and the conductor. As a result, the area of contact increases, so that the electrical resistance decreases. Thus, the electrical resistance is decreased by increasing the contact area, and by doing so, the electrical performance is stabilized, so that the terminal-connected wire of high quality can be obtained.

According to the invention, when the press-clamping member is press-clamped to the conductor after the conductor is received in the press-clamping member, the area of contact between the conductor and the press-clamping member is increased by the serrations disposed perpendicular to the axis of the press-clamping member, and therefore the electrical resistance, developing between the conductor and the press-clamping member, is decreased to a lower level.

According to the invention, when the press-clamping member is to be mounted on the press-clamping terminal, the press-clamping member is inserted into the groove portion, formed by the conductor press-clamping portion and the conductor press-fastening piece portions, from the upper side, and the conductor of the wire is inserted into the press-clamping member from the upper side. Therefore, the connection of the wire to the press-clamping member is effected from one direction, that is, from the upper side, and therefore this connecting operation is simple, and can be easily effected in an automated manner.

According to the invention, when the press-clamping member is mounted on the press-clamping terminal, the retaining portion is retainingly engaged with the conductor press-fastening piece portions, and therefore the press-clamping member is mounted on the press-clamping terminal in positioned relation thereto. Therefore, any skill is not required for mounting the press-clamping member on the press-clamping terminal, and this mounting operation can be accurately carried out without inviting a mounting error.

According to the invention, the press-clamping member, covering the conductor of the wire, is mounted on the press-clamping terminal, and the press-clamping member, covering the conductor, increases the pressure of contact between the press-clamping terminal and the conductor, and the area of contact increases, so that the electrical resistance decreases. Thus, the electrical resistance is decreased by increasing the contact area, and therefore the electrical performance is stabilized, so that the product of high quality is obtained.

According to the invention, the press-clamping member, covering the conductor and the portion of the sheath of the wire, is mounted on the press-clamping terminal, and the press-clamping member, covering the conductor and the portion of the sheath, increases the pressure of contact between the press-clamping terminal and the conductor, and the area of contact increases, so that the electrical resistance decreases. At this time, the conductor press-fastening piece portions are press-fastened to the press-clamping member, and therefore are electrically connected thereto, and also the sheath press-fastening piece portions are press-fastened to the press-clamping member, and therefore are electrically connected thereto. Therefore, the contact area is increased, so that the electrical resistance decreases, and therefore the electrical performance is stabilized, so that the product of high quality is obtained.

The wire press-clamping method of the invention can solve the problem that the contact area is decreased, so that the electrical resistance increases, and therefore by decreasing the electrical resistance by the increased contact area, there is achieved an advantage that the electrical performance is stabilized, so that the product of high quality can be obtained.

DETAIL DESCRIPTION OF PREFERRED EMBODIMENTS

Figure 1:
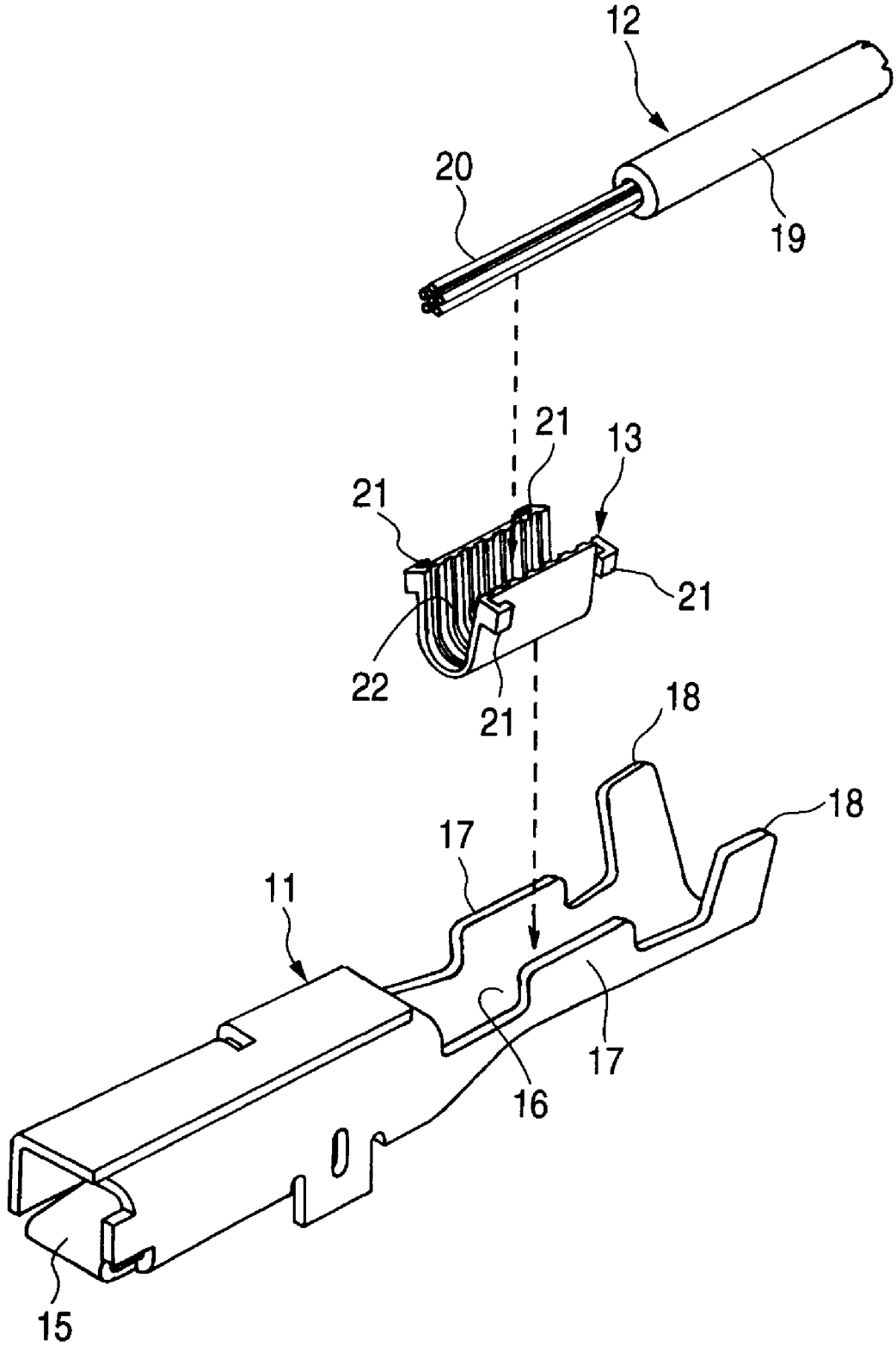
FIG. 1 is a perspective view of various parts used in a first embodiment of a wire press-clamping method of the invention, showing an assembling procedure.
Figure 2:
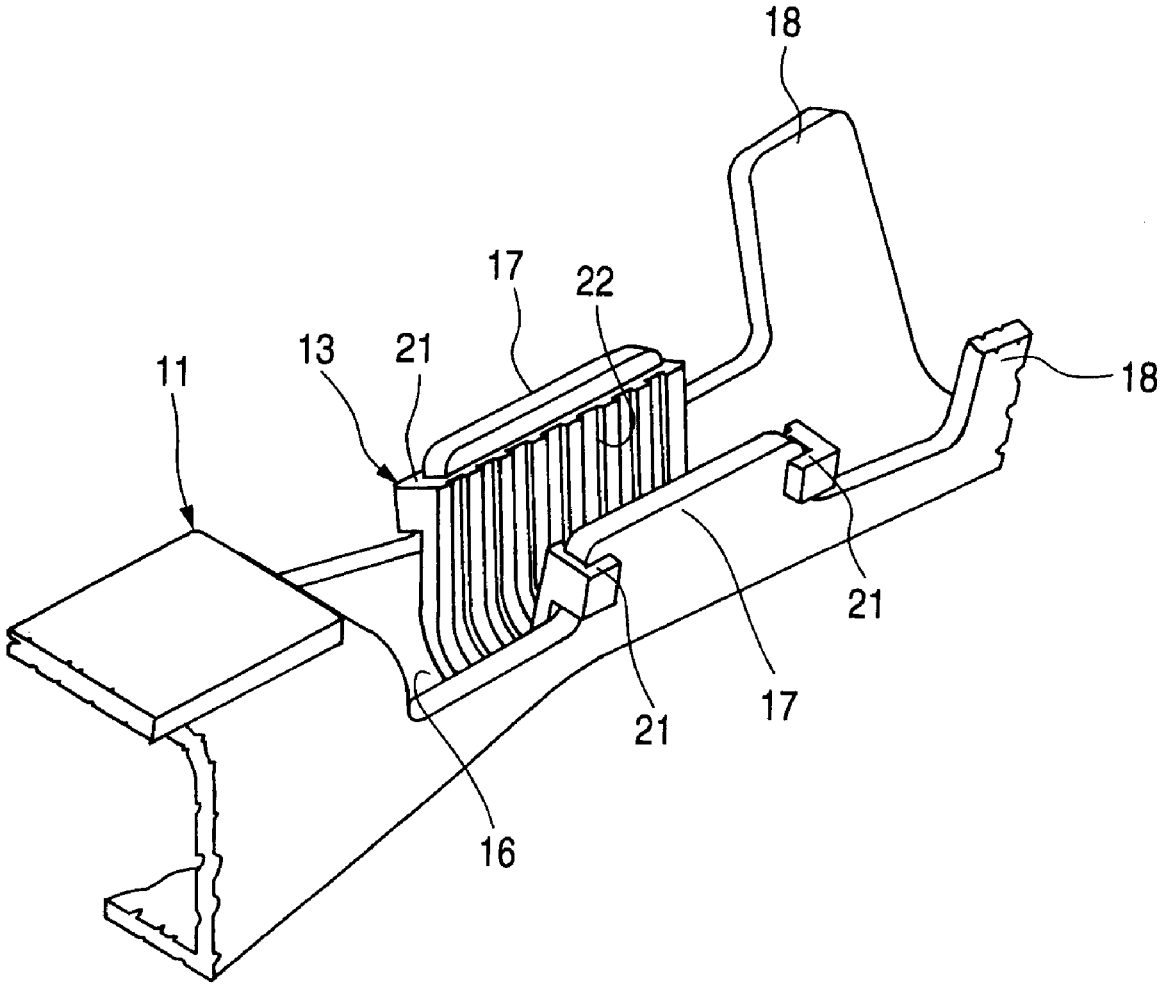
FIG. 2 is a partly-broken perspective view of a press-clamping terminal used in the wire press-clamping method of FIG. 1, showing a condition in which a press-clamping member is mounted on the press-clamping terminal.
Figure 3:
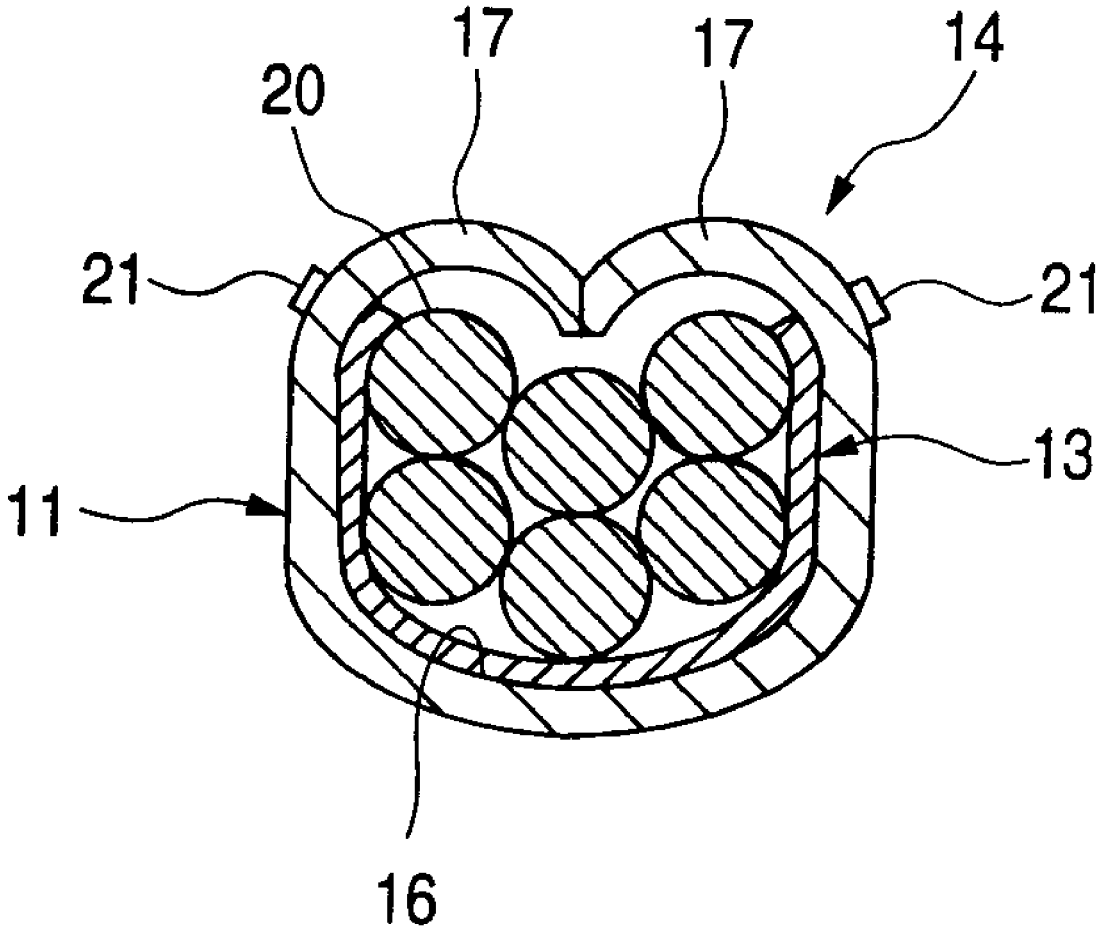
FIG. 3 is a cross-sectional view of a terminal-connected wire formed by the wire press-clamping method of FIG. 1.
Figure 4:
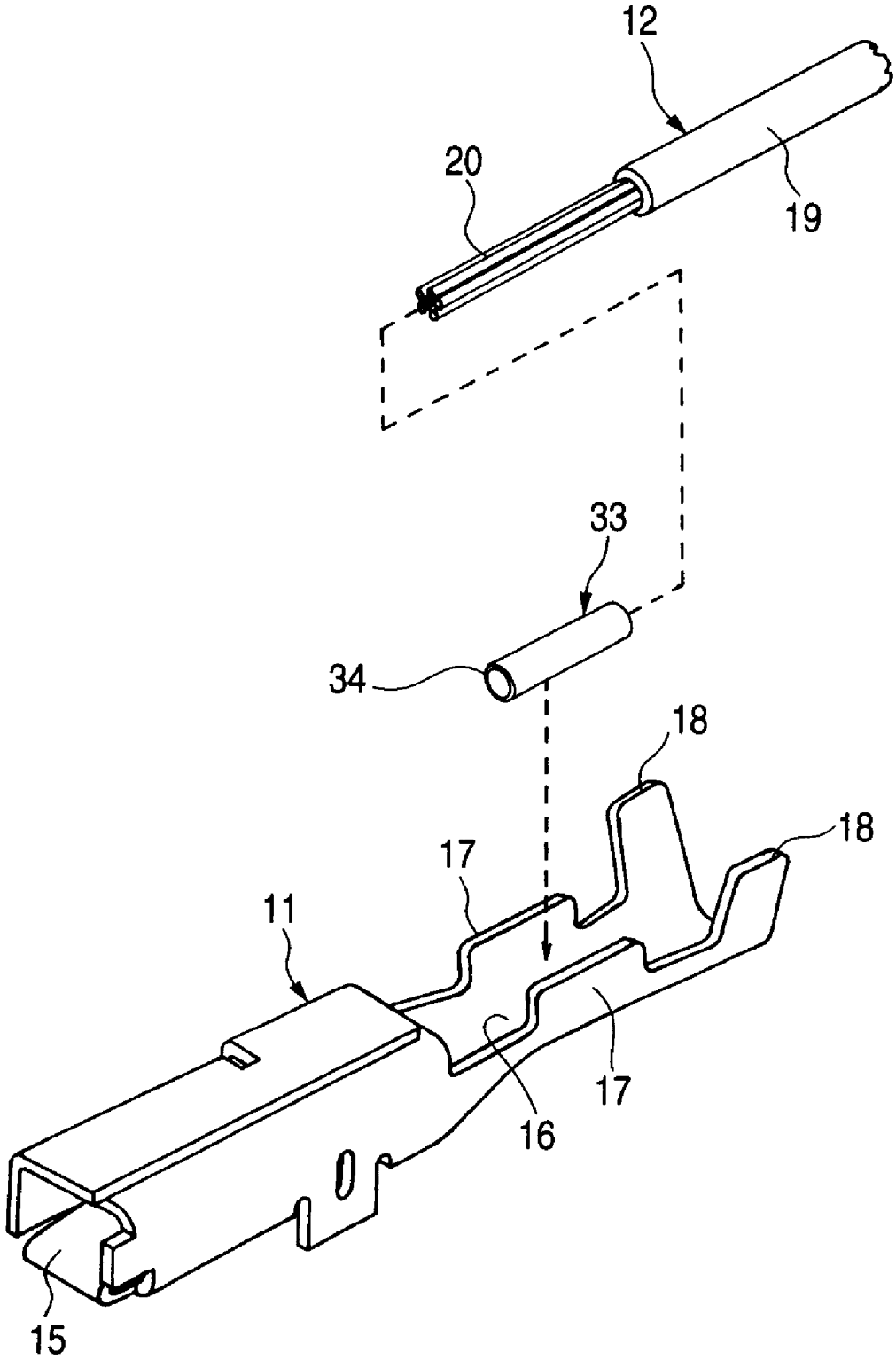
FIG. 4 is a perspective view of various parts used in a second embodiment of a wire press-clamping method of the invention, showing an assembling procedure.
Figure 5:
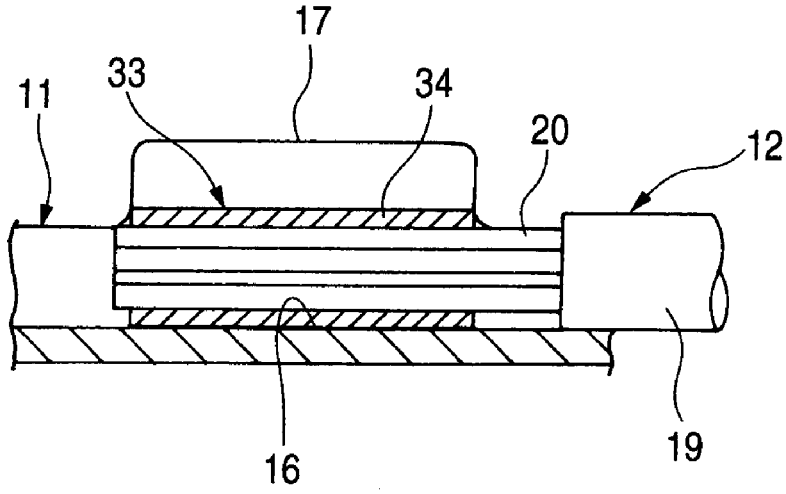
FIG. 5 is a cross-sectional view showing a condition in which a press-clamping member, used in the wire press-clamping method of FIG. 4, is mounted.
Figure 6:
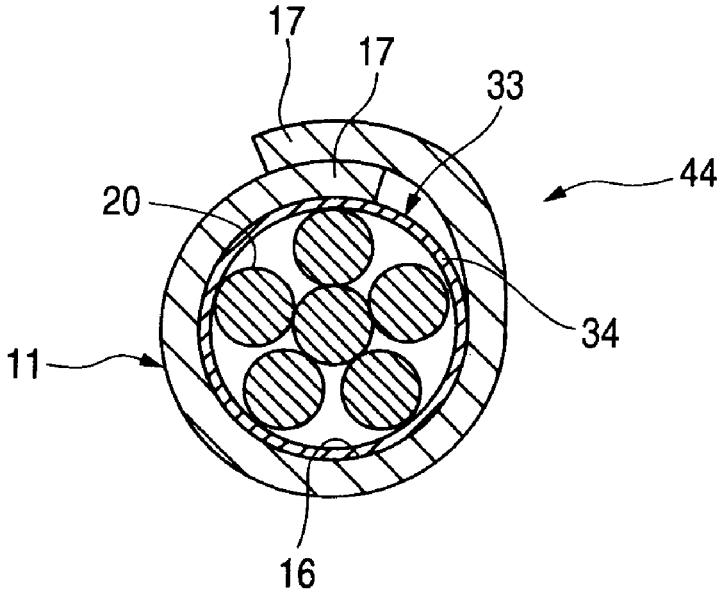
FIG. 6 is a cross-sectional view of a terminal-connected wire formed by the wire press-clamping method of FIG. 4.
Figure 7:
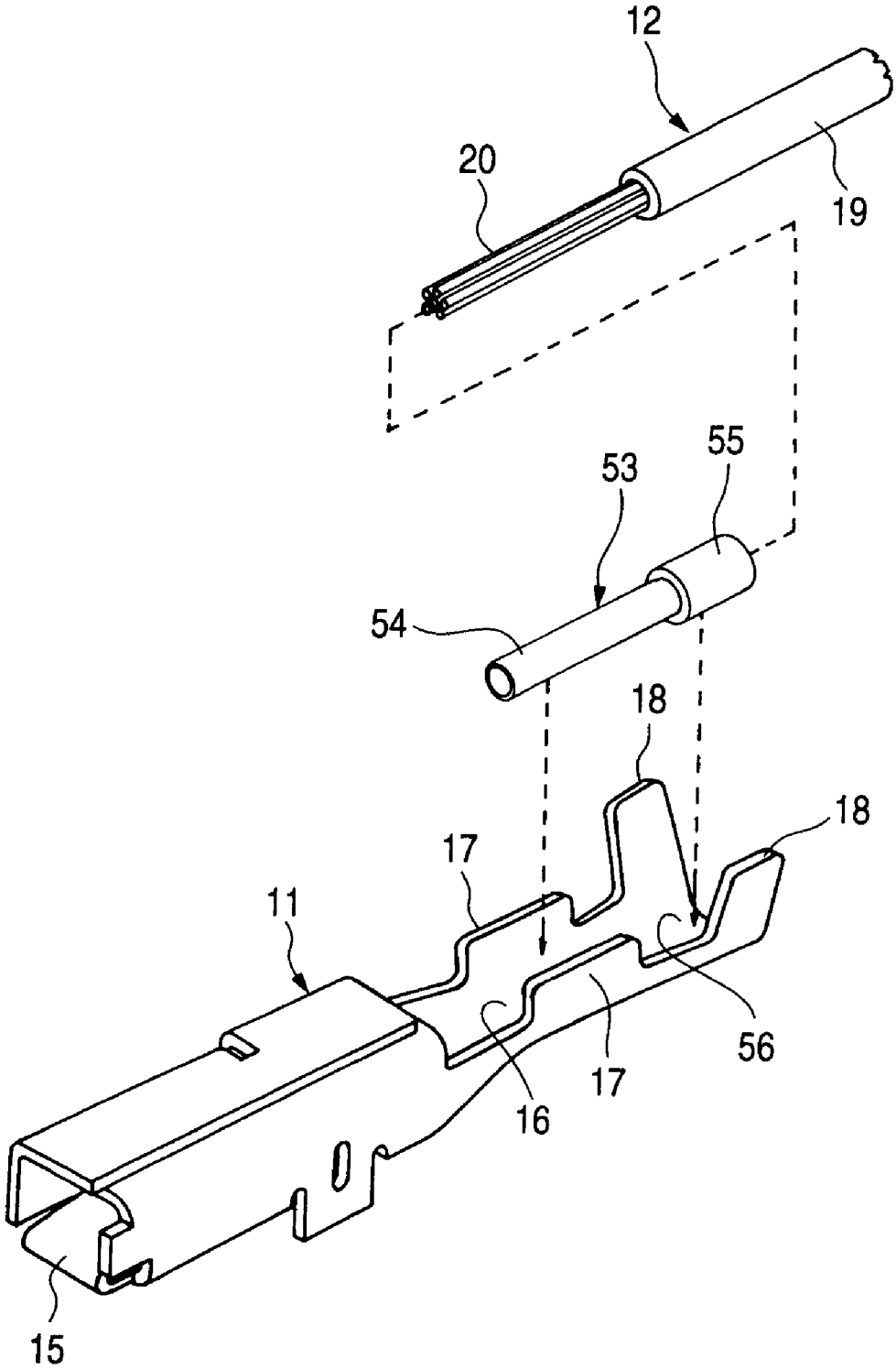
FIG. 7 is a perspective view of various parts used in a third embodiment of a wire press-clamping method of the invention, showing an assembling procedure.
Figure 8:
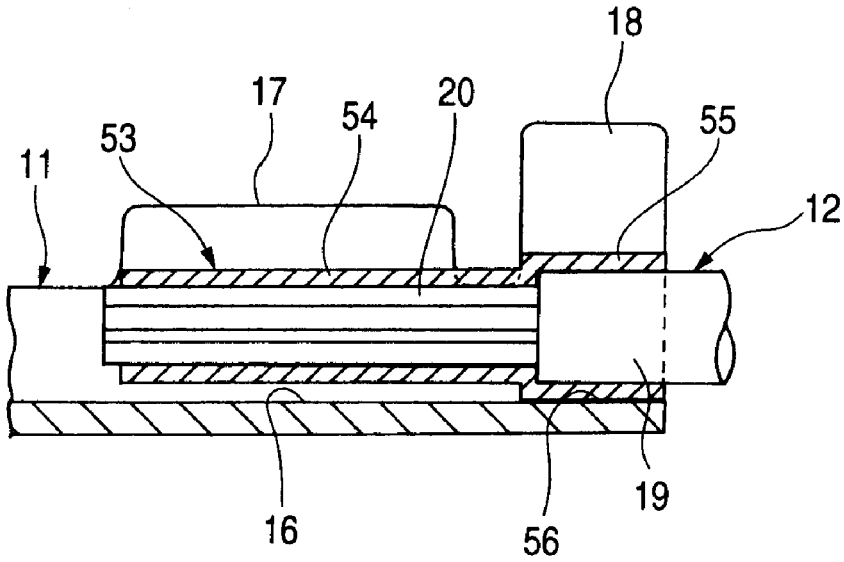
FIG. 8 is a cross-sectional view showing a condition in which a press-clamping member, used in the wire press-clamping method of FIG. 7, is mounted.
Figure 9:
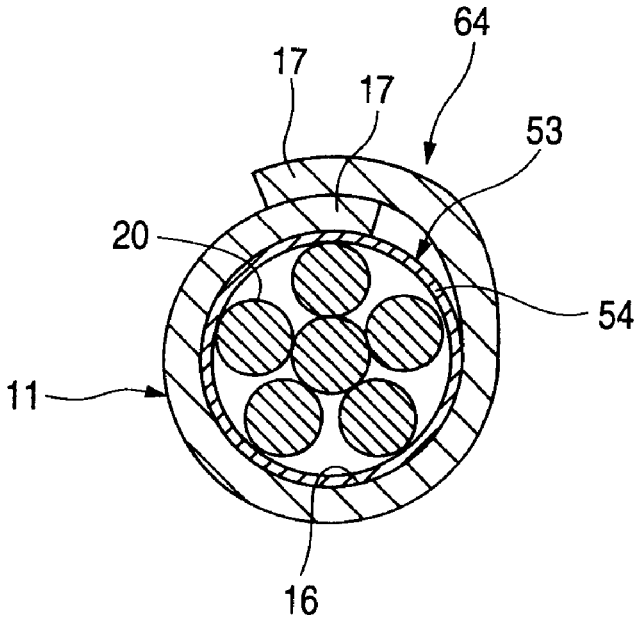
FIG. 9 is a cross-sectional view of a terminal-connected wire formed by the wire press-clamping method of FIG. 7.
Figure 10:
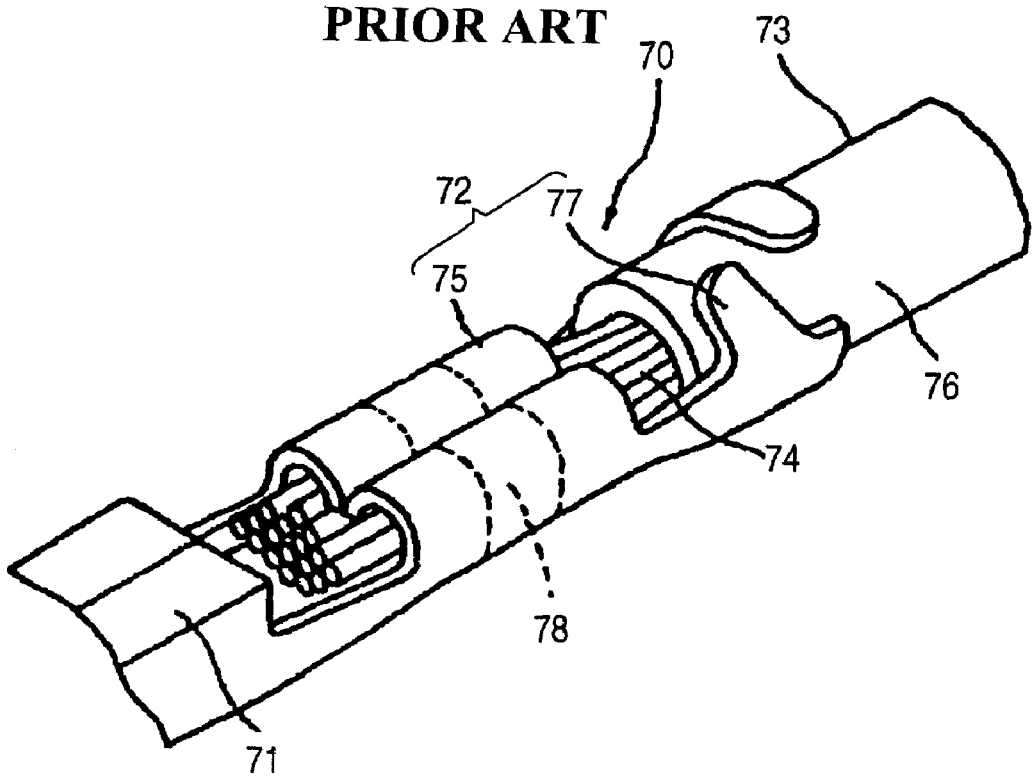
FIG. 10 PRIOR ART
FIG. 10 is a perspective view explanatory of a related wire press-clamping method.
Figure 11:
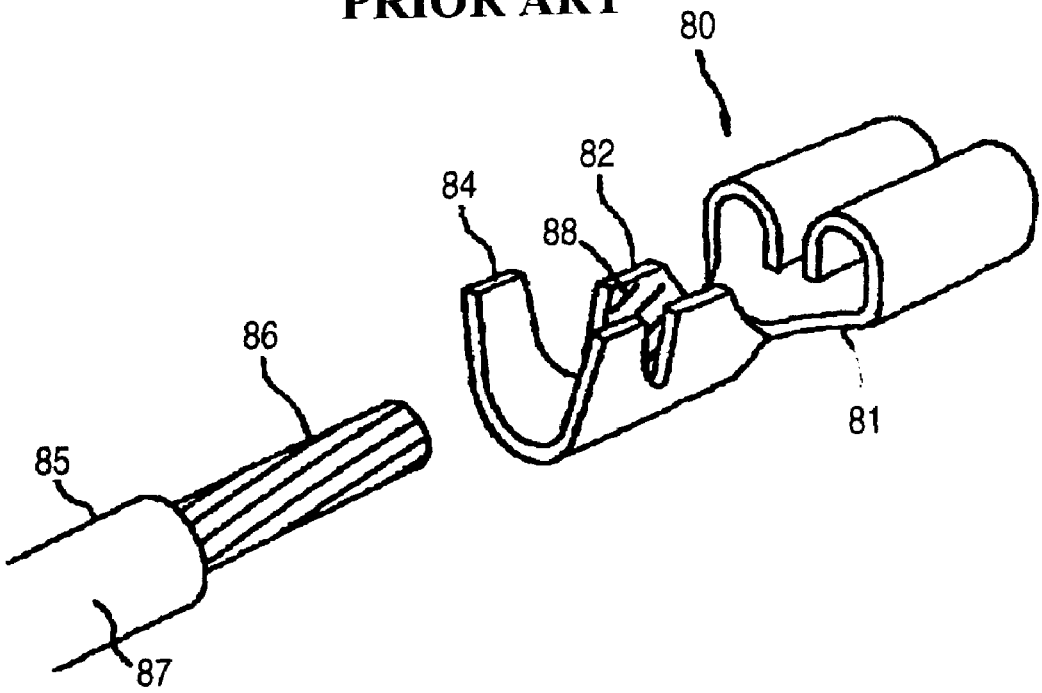
FIG. 11 PRIOR ART
FIG. 11 is a perspective view explanatory of a related wire press-clamping method different from the method of FIG. 10.

A plurality of preferred embodiments of the present inventions will now be described in detail with reference to the drawings. FIG. 1 is a perspective view of various parts used in a first embodiment of a wire press-clamping method of the invention, showing an assembling procedure, FIG. 2 is a partly-broken perspective view of a press-clamping terminal used in the wire press-clamping method of FIG. 1, showing a condition in which a press-clamping member is mounted on the press-clamping terminal, FIG. 3 is a cross-sectional view of a terminal-connected wire formed by the wire press-clamping method of FIG. 1, FIG. 4 is a perspective view of various parts used in a second embodiment of a wire press-clamping method of the invention, showing an assembling procedure, FIG. 5 is a cross-sectional view showing a condition in which a press-clamping member, used in the wire press-clamping method of FIG. 4, is mounted, FIG. 6 is a cross-sectional view of a terminal-connected wire formed by the wire press-clamping method of FIG. 4, FIG. 7 is a perspective view of various parts used in a third embodiment of a wire press-clamping method of the invention, showing an assembling procedure, FIG. 8 is a cross-sectional view showing a condition in which a press-clamping member, used in the wire press-clamping method of FIG. 7, is mounted, and FIG. 9 is a cross-sectional view of a terminal-connected wire formed by the wire press-clamping method of FIG. 7.

(First Embodiment)

As shown in FIG. 1, the first embodiment of the wire press-clamping method of the invention is designed to form the terminal-connected wire 14 (shown in FIG. 3), using the press-clamping terminal 11, a wire 12 and the press-clamping member 13.

The press-clamping terminal 11 is formed by bending a sheet of an electrically-conductive material, and this terminal 11 includes an electrical connecting portion 15 formed at one end portion thereof, a conductor press-clamping portion 16 and conductor press-fastening piece portions 17 which are formed at a central portion thereof, and sheath press-fastening piece portions 18 and 18 formed at the other end portion thereof. The electrical connecting portion 15 is formed into a male type or a female type, and is adapted to be electrically connected to a mating terminal of the female or the male type. The conductor press-clamping portion 16 has a U-shape transverse cross-section, and the pair of conductor press-fastening piece portions 17 project from upper edges of the conductor press-clamping portion 16, respectively. The sheath press-fastening piece portions 18 are formed on and project upwardly from the other end portion of the press-clamping terminal remote from an end of the conductor press-clamping portion 16.

The wire 12 includes a conductor 20 received within a sheath (covering portion) 19, and the conductor 20 consists, for example, of 5 or 6 aluminum wire elements.

The press-clamping member 13 is formed of a thin sheet of an electrically-conductive copper alloy, and has a U-shaped transverse cross-section, and has the function of stabilizing an electrical resistance without compressing the conductor 20. The press-clamping member 13 is analogous in shape to a groove portion formed by the conductor press-clamping portion 16 and conductor press-fastening piece portions 17 of the press-clamping terminal 11, and an axial length of the press-clamping member 13 is substantially equal to an axial length of the conductor press-fastening piece portions 17, and the press-clamping member 13 is so sized as to fit in this groove portion. The press-clamping member 13 has two pairs of retaining portions 21, and the pair of retaining portions 21 are formed at an upper end portion of each of opposed side walls of the press-clamping member 13, and the two pairs of retaining portions 21 can be retainingly engaged with the conductor press-fastening piece portions 17 of the press-clamping terminal 11, respectively. Serrations 22 are arranged at an inner peripheral surface of the press-clamping member 13, and extend in a direction perpendicular to the axis thereof.

The press-clamping member 13 is inserted or fitted into the groove portion formed by the conductor press-clamping portion 16 and conductor press-fastening piece portions 17 of the press-clamping terminal 11, and the pair of retaining portions 21 on one side wall of the press-clamping terminal 13 are retainingly engaged with one conductor press-fastening piece portion 17, while the pair of retaining portions 21 on the other side wall of the press-clamping member 13 are retainingly engaged with the other conductor press-fastening piece portion 17. The conductor 20 of the wire 12 is inserted or received in the press-clamping member 13, so that the press-clamping member 13 is disposed between the conductor press-clamping portion 16 of the press-clamping terminal 11 and the conductor 20, and then the press-clamping member 13 is press-fastened by the conductor press-fastening portions 17. At this time, since the press-clamping member 13 is equal in axial length to the conductor press-fastening piece portions 17, the press-clamping member 13 receives a press-fastening force from the conductor press-fastening piece portions 17 uniformly over the entire length thereof, and therefore can apply a uniform press-clamping force to the conductor 20.

During the time when the press-clamping member 13 is pressed by the conductor press-fastening piece portions 17 to be press-clamped to the conductor 20, a mechanical strength of the conductor 20 is decreasing to a level lower than a breaking strength of the conductor. In contrast, the press-clamping member 13 serves to increase the pressure of contact between the conductor press-clamping portion 16 and the conductor 20, and therefore the area of contact therebetween increases, so that the electrical resistance decreases. Thus, the electrical resistance is decreased by increasing the contact area, and by doing so, the electrical performance is stabilized, so that the terminal-connected wire 14 of high quality can be obtained.

When the press-clamping member 13 is to be mounted on the press-clamping terminal 11, the press-clamping member 13 is inserted into the groove portion, formed by the conductor press-clamping portion 16 and the conductor press-fastening piece portions 17, from the upper side, and the conductor 20 of the wire 12 is inserted into the press-clamping member 13 from the upper side. Therefore, the connection of the wire 12 to the press-clamping member 13 is effected from one direction, that is, from the upper side, and therefore this connecting operation is simple, and can be easily effected in an automated manner.

When the press-clamping member 13 is press-clamped to the conductor 20 after the conductor 20 is inserted in the press-clamping member 13, the area of contact between the press-clamping member 13 and the conductor 20 is increased by the serrations 22 arranged perpendicular to the axis of the press-clamping member 13, and therefore the electrical resistance, developing between the press-clamping member 13 and the conductor 20, decreases.

As shown in FIG. 2, when the press-clamping member 13 is mounted on the press-clamping terminal 11, the pair of retaining portions 21 on the one side wall of the press-clamping terminal 13 are retainingly engaged with the one conductor press-fastening piece portion 17, while the pair of retaining portions 21 on the other side wall of the press-clamping member 13 are retainingly engaged with the other conductor press-fastening piece portion 17, and therefore the press-clamping member 13 is mounted on the press-clamping terminal 11 in positioned relation to the conductor press-clamping portion 16 of the press-clamping terminal 11. Therefore, any skill is not required for mounting the press-clamping member 13 on the press-clamping terminal 11, and this mounting operation can be accurately carried out without inviting a mounting error.

As shown in FIG. 3, when the conductor press-fastening piece portions 17 are press-fastened by a press-fastening jig (not shown), the conductor press-fastening piece portions 17 are deformed into a curved shape to press the upper end portions of the press-clamping member 13 and the conductor 20 of the wire 12. As a result, the upper end portions of the press-clamping member 30 are also deformed inwardly into a curved shape to generally conform in shape to the conductor 20. At this time, the press-clamping member 13 performs the function of stabilizing the electrical resistance without compressing the conductor 20 of the wire 12, and therefore the pressure of contact between the press-clamping terminal 11 and the conductor 20 is increased, and by doing so, the electrical connection is effected in such a manner that the area of contact therebetween is increased, thereby decreasing the electrical resistance. As a result, the electrical performance is stabilized, so that the terminal-connected wire 14 of high quality can be obtained.

In the wire press-clamping method of the first embodiment, the press-clamping member 13 has the function of stabilizing the electrical resistance without compressing the conductor 20, and therefore the area of contact between the press-clamping terminal 11 and the press-clamping member 13, as well as the area of contact between the press-clamping member 13 and the conductor 20, increases, so that the electrical resistance decreases. Thus, the electrical resistance is decreased by increasing the contact area, and by doing so, the electrical performance is stabilized, so that the terminal-connected wire 14 of high quality can be obtained.

In the wire press-clamping method of the first embodiment, when the press-clamping member 13 is press-clamped to the conductor 20 after the conductor 20 is received in the press-clamping member 13, the area of contact between the conductor 20 and the press-clamping member 13 is increased by the serrations 22 disposed perpendicular to the axis of the press-clamping member 13, and therefore the electrical resistance, developing between the conductor 20 and the press-clamping member 13, is positively decreased.

In the wire press-clamping method of the first embodiment, when the press-clamping member 13 is to be mounted on the press-clamping terminal 11, the press-clamping member 13 is inserted into the groove portion, formed by the conductor press-clamping portion 16 and the conductor press-fastening piece portions 17, from the upper side, and the conductor 20 of the wire 12 is inserted into the press-clamping member 13, mounted on the press-clamping terminal 11, from the upper side. Therefore, the inserting direction of the wire 12 and the press-clamping member 13 is effected from one direction, that is, from the upper side, and therefore this connecting operation is simple, and can be easily effected in an automated manner.

In the wire press-clamping method of the first embodiment, when the press-clamping member 13 is mounted on the press-clamping terminal 11, the retaining portions 21 are retainingly engaged with the conductor press-fastening piece portions 17, and therefore the press-clamping member 13 is mounted on the press-clamping terminal 13 in positioned relation thereto. Therefore, any skill is not required for mounting the press-clamping member 13 on the press-clamping terminal 11, and this mounting operation can be accurately carried out without inviting a mounting error.

(Second Embodiment)

Next, the second embodiment of the invention will be described with reference to FIGS. 4 to 6. In each of the second and subsequent embodiments, those members, etc., similar in construction and function to the already-described members, etc., will be designated by identical or like reference numerals in the drawings, and explanation thereof will be made briefly or omitted.

As shown in FIG. 4, the wire press-clamping method of the second embodiment is designed to form the terminal-connected wire 44 (shown in FIG. 6), using a press-clamping terminal 11, a wire 12 and the press-clamping member 33.

The press-clamping member 33 is made of an electrically-conductive copper alloy, and includes a tubular body 34 for the passage of a conductor 20 of the wire 12 therethrough, the tubular body 34 being in the form of a cylinder having a thin peripheral wall. The press-claming member 33 has such an outer diameter as to be inserted or fitted into a groove portion formed by a conductor press-clamping portion 16 and conductor press-fastening piece portions 17 of the press-clamping terminal 11, and an axial length of the press-clamping member 33 is substantially equal to an axial length of the conductor press-fastening piece portions 17. An inner diameter of the press-clamping member 33 is slightly larger than an outer diameter of the conductor 20 of the wire 12.

The press-clamping member 33, having the conductor 20 of the wire 12 passed therethrough, is inserted or fitted into the groove portion formed by the conductor press-clamping portion 16 and conductor press-fastening piece portions 17 of the press-clamping terminal 11, so that the press-clamping member 33 is interposed between the conductor press-clamping portion 16 of the press-clamping terminal 11 and the conductor 20. Then, the press-clamping member 33 is press-fastened by the conductor press-fastening piece portions 17. At this time, the press-clamping member 33 in a sub-assembled condition in which the conductor 20 of the wire 12 is passed therethrough is transferred to the press-clamping terminal 11, and therefore the transfer is simple, and can be carried out in an automated manner.

As shown in FIG. 5, when the press-clamping member 33, having the conductor 20 of the wire 12 passed therethrough, is inserted into the groove portion formed by the conductor press-clamping portion 16 and conductor press-fastening piece portions 17 of the press-clamping terminal 11, and is press-fastened, the press-clamping member 33 receives a press-fastening force from the conductor press-fastening piece portions 17 uniformly over the entire length thereof, and therefore applies a uniform press-clamping force to the conductor 20 since the press-clamping member 33 is substantially equal in axial length to the conductor press-fastening piece portions 17.

As shown in FIG. 6, when the conductor press-fastening piece portions 17 are press-fastened by a press-fastening jig (not shown), the conductor press-fastening piece portions 17 are deformed, so that their distal end portions are curved to overlap each other. Thus, the conductor press-fastening piece portions 17 are subjected to so-called lap-crimping, and press the press-clamping member 33 and the conductor 20 of the wire 12 to be electrically connected thereto. At this time, the press-clamping member 33, covering the conductor 20 of the wire 12, is deformed to generally conform in shape to the conductor 20. The press-clamping member 33 has the function of stabilizing the electrical resistance without compressing the conductor 20 of the wire 12, and therefore the press-clamping member 33 increases the pressure of contact between the press-clamping terminal 11 and the conductor 20, and by doing so, the electrical connection is effected in such a manner that the area of contact therebetween is increased, thereby decreasing the electrical resistance. As a result, the electrical performance is stabilized, so that the terminal-connected wire 44 of high quality can be obtained. The press-clamping member 33 can be formed into a C-shaped transverse cross-section, in which case the press-clamping of the press-clamping member to the conductor 20 is more promoted.

In the wire press-clamping method of the second embodiment, the press-clamping member 33, covering the conductor 20 of the wire 12, is mounted on the press-clamping terminal 11, and the press-clamping member 33, covering the conductor 20, increases the pressure of contact between the press-clamping terminal 11 and the conductor 20, and the area of contact increases, so that the electrical resistance decreases. Thus, the electrical resistance is decreased by increasing the contact area, and therefore the electrical performance is stabilized, so that the product of high quality is obtained.

(Third Embodiment)

Next, the third embodiment of the invention will be described with reference to FIGS. 7 to 9.

As shown in FIG. 4, the wire press-clamping method of the third embodiment is designed to form the terminal-connected wire 64 (shown in FIG. 9), using a press-clamping terminal 11, a wire 12 and the press-clamping member 53.

The press-clamping member 53 is made of an electrically-conductive copper alloy, and this press-clamping member 53 of an integral construction includes a first tubular portion 54 for the passage of a conductor 20 of the wire 12 therethrough, and a second tubular portion 55 for covering a sheath 19 of the wire 12, each of the first and second tubular portions 54 and 55 being in the form of a cylinder having a thin peripheral wall. The first tubular portion 54 of the press-claming member 53 has such an outer diameter as to be inserted or fitted into a groove portion formed by a conductor press-clamping portion 16 and conductor press-fastening piece portions 17 of the press-clamping terminal 11, and an axial length of the first tubular portion 54 is substantially equal to an axial length of the conductor press-fastening piece portions 17. The second tubular portion 55 has such an outer diameter as to be inserted into a groove portion formed by a sheath press-clamping portion 56 and sheath press-fastening piece portions 18 which are formed at the other end portion of the press-clamping terminal 11 remote from an end of the conductor press-clamping portion 16. An axial length of the second tubular portion 55 is substantially equal to an axial length of the sheath press-fastening piece portions 18. An inner diameter of the first tubular portion 54 is slightly larger than an outer diameter of the conductor 20 of the wire 12, and an inner diameter of the second tubular portion 55 is slightly larger than an outer diameter of the sheath 19 of the wire 12.

The wire 12 is passed through the press-clamping member 53, and the conductor 20 of the wire 12 is disposed in the first tubular portion 54, while the sheath 19 is disposed in the second tubular portion 55. The first tubular portion 54 is inserted or fitted into the groove portion formed by the conductor press-clamping portion 16 and conductor press-fastening piece portions 17 of the press-clamping terminal 11, while the second tubular portion 55 is inserted into the groove portion formed by the sheath press-clamping portion 56 and the sheath press-fastening piece portions 18. Thus, the first tubular portion 54 is interposed between the conductor press-clamping portion 16 of the press-clamping terminal 11 and the conductor 20. Then, the press-clamping member 53 is press-fastened by the conductor press-fastening piece portions 17 and the sheath press-fastening piece portions 18. At this time, the press-clamping member 53 in a sub-assembled condition in which the conductor 20 and sheath 19 of the wire 12 are passed respectively through the first and second tubular portions 54 and 55 is transferred to the press-clamping terminal 11, and therefore the transfer is simple, and can be carried out in an automated manner.

As shown in FIG. 8, when the press-clamping member 53, having the conductor 20 and sheath 19 of the wire 12 passed respectively through the first and second tubular portions 54 and 55, is inserted into the groove portion of the press-clamping terminal 11, and is press-fastened, the press-clamping member 53 receives a press-fastening force from the conductor press-fastening piece portions 17 and the sheath press-fastening piece portions 18 uniformly over the entire length thereof, and therefore applies a uniform press-clamping force to the conductor 20 and the sheath 19 since the first and second tubular portions 54 and 55 is substantially equal in axial length respectively to the conductor press-fastening piece portions 17 and the sheath press-fastening piece portions 18.

As shown in FIG. 9, when the conductor press-fastening piece portions 17 and the sheath press-fastening piece portions 18 are press-fastened by a press-fastening jig (not shown), the conductor press-fastening piece portions 17, as well as the sheath press-fastening piece portions 18, are deformed, so that their distal end portions are curved to overlap each other. Thus, the conductor press-fastening piece portions 17 and the sheath press-fastening piece portions 18 are subjected to so-called lap-crimping, and press the press-clamping member 53 and the conductor 20 and sheath 19 of the wire 12 to be electrically connected thereto. At this time, the first tubular portion 54 of the press-clamping member 53, covering the conductor 20 of the wire 12, is deformed to generally conform in shape to the conductor 20. That portion of the press-clamping member 53, lying between the conductor press-fastening piece portions 17 and the sheath press-fastening piece portions 18, is deformed in a bulging manner since the press-clamping member 53 is press-deformed at opposite ends of this intervening portion. As a result, there is obtained a wedge effect that prevents the rearward withdrawal, and also increases the strength. The press-clamping member 53 has the function of stabilizing the electrical resistance without compressing the conductor 20 of the wire 12, and therefore the press-clamping member 53 increases the pressure of contact between the press-clamping terminal 11 and the conductor 20, and by doing so, the electrical connection is effected in such a manner that the area of contact therebetween is increased, thereby decreasing the electrical resistance. As a result, the electrical performance is stabilized, so that the terminal-connected wire 64 of high quality can be obtained. A cap-like cover is fitted on the distal end portion of the conductor 20 projecting from the first tubular portion 54 press-fastened by the conductor press-fastening piece portions 17, and by doing so, a waterproof performance is enhanced. The press-clamping member 53 can be formed into a C-shaped transverse cross-section, in which case the press-clamping of the press-clamping member to the conductor 20 is more promoted.

In the wire press-clamping method of the third embodiment, the press-clamping member 53, covering the conductor 20 and sheath 19 of the wire 12, is mounted on the press-clamping terminal 11, and the press-clamping member 53, covering the conductor 20 and the sheath 19, increases the pressure of contact between the press-clamping terminal 11 and the conductor 20, and the area of contact increases, so that the electrical resistance decreases. At this time, the conductor press-fastening piece portions 17 are press-fastened to the press-clamping member 53, and therefore are electrically connected thereto, and also the sheath press-fastening piece portions 18 are press-fastened to the press-clamping member 53, and therefore are electrically connected thereto. Therefore, the contact area is increased, so that the electrical resistance decreases, and therefore the electrical performance is stabilized, so that the product of high quality is obtained.

The present invention is not limited to the above embodiments, and suitable modifications, improvements and so on can be made.

For example, the number of the wire elements of the conductor of the wire, the diameter of the conductor and the diameter of the groove portion of the press-clamping terminal are determined in accordance with the design of a circuit to which the terminal-connected wire is applied, and accordingly the diameter of the press-clamping member is determined.

The material of which the press-clamping member is made is not limited to the copper alloy, and any other suitable metal or resin, which is electrically conductive and deformable, can be used.

What is claimed is:

1. A terminal-connected wire comprising:

a wire that includes a conductor;

a press-clamping terminal that includes;

a conductive press-clamping terminal body;

an electrical connecting portion that is formed at an end portion of the press-clamping terminal body, and is connected to a mating terminal;

a conductor press-clamping portion that is formed at a portion corresponding to the conductor; and conductor press-fastening piece portions that are extended from opposite sides of the conductor press-clamping portion in an axial direction; and a conductive press-clamping member that is held in contact with the conductor, wherein the press-clamping member is analogous in shape to a groove portion formed by the conductor press-clamping portion and the conductor press-fastening piece portions, and wherein the conductor press-fastening piece portions is press-fastened to the press-clamping member, so that the conductor is electrically connected to the conductor press-clamping portion through the press-clamping member.

2. The terminal-connector wire according to claim 1, wherein the member has a U-shape corresponding to the groove portion.

3. The terminal-connected wire according to claim 1, wherein the press-clamping member includes a retaining portion that is engaged with the conductor press-fastening piece portions.

4. The terminal-connected wire according to claim 1, wherein length of the press-clamping member is substantially equal to length of the conductor press-fastening piece portion in the axial direction.

5. The terminal-connected wire according to claim 1, wherein the press-clamping member includes serrations which are arranged on an surface that is held contact with the conductor, and extend in a direction perpendicular to the axial direction.

6. The terminal-connected wire according to claim 1, wherein the wire includes a sheath that covers the conductor, and the press-clamping terminal includes sheath press fastening piece portions that are extended from opposite sides of a portion opposed to the electrical connecting portion of the press-clamping terminal body in the axial direction, and wherein the sheath press-fastening piece portions are press fastened to the sheath.

* * * * *